US007868718B2

(12) United States Patent
Yasuda et al.

(10) Patent No.: US 7,868,718 B2
(45) **Date of Patent: *Jan. 11, 2011**

(54) BALANCED FILTER DEVICE

(75) Inventors: Hisahiro Yasuda, Gunma (JP); Takeshi Kosaka, Gunma (JP); Makoto Inoue, Gunma (JP)

(73) Assignee: Taiyo Yuden, Co., Ltd. (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/132,569

(22) Filed: Jun. 3, 2008

(65) Prior Publication Data

US 2008/0303607 A1 Dec. 11, 2008

Related U.S. Application Data

(62) Division of application No. 11/241,163, filed on Sep. 30, 2005, now Pat. No. 7,397,328.

(30) Foreign Application Priority Data

Sep. 30, 2004 (JP) ..... 2004-289261
Oct. 21, 2004 (JP) ..... 2004-306829
May 30, 2005 (JP) ..... 2005-157411

(51) Int. Cl.
*H01P 1/203* (2006.01)
*H01P 5/10* (2006.01)

(52) U.S. Cl. ..... 333/204; 333/26

(58) Field of Classification Search ..... 333/25, 333/26, 33, 35, 128, 204
See application file for complete search history.

(56) References Cited

U.S. PATENT DOCUMENTS 6,294,965 B1 9/2001 Merrill et al.
6,377,134 B1 * 4/2002 Takenaka ..... 333/161
6,420,942 B1 7/2002 Hiroshima et al.
6,529,099 B1 * 3/2003 Takenaka ..... 333/156
6,538,534 B2 3/2003 Hirai et al.
6,788,164 B2 9/2004 Maekawa et al.
6,819,199 B2 11/2004 Burns et al.
7,126,444 B2 10/2006 Fukunaga et al.
7,256,663 B2 8/2007 Yasuda et al.
2002/0171529 A1 11/2002 Tang
2003/0020568 A1 1/2003 Mizutani et al.
2004/0164817 A1 8/2004 Nosaka
2006/0022773 A1 2/2006 Iwasaki et al.

FOREIGN PATENT DOCUMENTS

EP 1 282 190 A2 2/2003
EP 1 394 894 A1 3/2004
JP 02-062101 3/1990
JP 06-077703 3/1994
JP 07-273516 10/1995
JP 07-283611 10/1995

(Continued)

*Primary Examiner*—Benny Lee
*Assistant Examiner*—Gerald Stevens
(74) *Attorney, Agent, or Firm*—Chen Yoshimura LLP

(57) ABSTRACT

A balanced filter suitable for a reduction of the filter size. The balanced filter comprises strip-line resonators (SL1*a*, SL1*b*) constituting resonance electrodes coupled to an unbalanced terminal, strip-line resonators (SL3*a*, SL3*b*) coupled directly to balanced side terminals and strip-line resonators (SL2*a*, SL2*b*) coupled to the balanced side terminals through impedance elements (Z).

5 Claims, 11 Drawing Sheets

FOREIGN PATENT DOCUMENTS

| | | |
|---|---|---|
| JP | 2001-036310 | 2/2001 |
| JP | 2003-087008 | 3/2003 |
| JP | 2004-056745 | 2/2004 |
| JP | 2004-112787 | 4/2004 |
| JP | 2005-080248 | 3/2005 |
| JP | 2000-134009 | 12/2005 |

* cited by examiner (a)

(b)

(a)

(b)

(a)

(b)

(a)

(b)

(a)

(b)

(a)

(b)

BALANCED FILTER DEVICE

CROSS REFERENCE TO RELATED APPLICATIONS

This application is a divisional of U.S. patent application Ser. No. 11/241,163 filed on Sep. 30, 2005, now U.S. Pat. No. 7,397,328, which application is hereby incorporated by reference in its entirety.

BACKGROUND OF THE INVENTION

1. Field of the Invention

The present invention relates to a balanced filter having the function of a balun performing conversion between unbalanced and balanced signals and the function of a filter performing band control, and more particularly to a balanced filter effective in reducing a filter size.

2. Description of the Related Art

Radio communication equipment comprises various RF (radio frequency) devices, such as an antenna, a filter, an RF switch, a power amplifier, an RF-IC, and a balun. Among these parts, resonance devices, such as an antenna and a filter, handle an unbalanced signal on the basis of the ground potential, while an RF-IC for producing and processing an RF signal handles a balanced signal. A balun functioning as an unbalance-balance transformer is therefore used when those two types of parts are connected to each other.

That type of balun is disclosed, for example, in the following Patent Documents:

Patent Document 1: Japanese Unexamined Patent Application Publication No. 2000-134009

Patent Document 2: Japanese Unexamined Patent Application Publication No. 2001-36310

The baluns disclosed in those Patent Documents are of the type that an unbalanced line and a balanced line are coupled through a coupling line. In the structures of those baluns, as shown in FIG. 3 of Patent Document 2, the unbalanced line and the balanced line are formed on one substrate, and the coupling line is formed on another substrate. The coupling line is laid over both the unbalanced line and the balanced line so that the unbalanced line and the balanced line are coupled to each other.

In a coupling mode of the balun thus constructed, as shown in FIG. 8 and explained in paragraph 0016 of Patent Document 2, "an unbalanced signal inputted from an unbalanced signal terminal 3 is propagated in the order of a first coupling line 101, a second coupling line 102, and a third coupling line 103".

With the balun structures disclosed in Patent Documents 1 and 2, however, a resulting frequency characteristic is as shown in FIG. 4 of Patent Document 2. Accordingly, the disclosed structures are usable as a balun, but they have a difficulty in ensuring a band characteristic required for the filter.

On the other hand, many balanced filters each comprising a balun and a filter combined into an integral unit have recently been devised with the intent to reduce the size of radio communication equipment. That type of balanced filter is disclosed, for example, in the following Patent Document:

Patent Document 3: Japanese Unexamined Patent Application Publication No. 2003-087008

The balanced filter disclosed in Patent Document 3 has a structure in which a filter and a balun each designed using a ¼-wavelength resonator are combined on a dielectric substrate. A dielectric layer constituting the filter and a dielectric layer constituting the balun are formed one above the other in an integral structure.

Also, Patent Document 3 discloses a structure in which a DC power supply layer is formed in the balun, for making the balanced filter adaptable for the case where the RF-IC requires a balanced signal superimposed on a DC component. This structure is intended to realize a further reduction of the filter size.

However, the structure in which a balun section and a filter section are separately formed and integrated together has the problem as follows. When the filter function with a high attenuation is demanded, the filter section is required to have a multistage structure. Therefore, satisfactory flexibility in design cannot be ensured in a limited space, and a reduction of the size is very difficult to realize.

SUMMARY OF THE INVENTION

Accordingly, it is an object of the present invention to provide a balanced filter which is effective in realizing a high attenuation and a size reduction.

To achieve the above object, one embodiment provides a balanced filter device comprising an unbalanced-side resonance electrode and a balanced-side resonance electrode, wherein the balanced filter device further comprises a stage constituting resonance electrode formed in comb-line arrangement relative to the unbalanced-side resonance electrode and/or the balanced-side resonance electrode.

By thus arranging another resonance electrode in comb-line arrangement relative to the resonance electrode constituting a balun, the balun and a filter are constituted at the same time in a state partly sharing resonators. Therefore, the signal converting function of the balun and the band control effect of the filter can be both obtained with a simple structure. Here, the term "comb-line arrangement" means the arrangement that respective shorted ends of the resonance electrodes are positioned to face in the same direction.

Another embodiment provides a balanced filter device comprising an unbalanced-side resonance electrode and a balanced-side resonance electrode, wherein the balanced filter device further comprises a stage constituting resonance electrode coupled to the balanced-side resonance electrode through an impedance element.

By thus coupling the balanced-side resonance electrode and the stage constituting resonance electrode through the impedance element, a band control effect can be obtained in the filter. Here, the impedance element may be a capacitive or inductive device. In practice, the balanced-side resonance electrode and the stage constituting resonance electrode can be arranged in opposed relation with a dielectric interposed between them, to thereby establish capacitive coupling. Alternatively, the balanced-side resonance electrode and the stage constituting resonance electrode can be coupled to each other through a line having an inductance component.

Another embodiment has multi-path coupling formed between the stage constituting resonance electrode and the unbalanced-side resonance electrode.

By thus forming the multi-path coupling, second and third extremes can be given to the resulting filter characteristic, and a sharper filter function can be obtained. Here, the term "multi-path coupling" means a capacitive or inductive coupling path formed between one electrode and another electrode.

In some embodiments the coupling portions of the unbalanced-side resonance electrode and the balanced-side resonance electrode are formed of strip-lines each having a length of λ/4, and the stage constituting resonance electrode is formed of a strip-line having a length different from λ/4.

By thus forming the stage constituting resonance electrode of a strip-line having a length different from λ/4, an adjustment of inner-layer impedance can be realized with change in the length of the stage constituting resonance electrode.

Another embodiment provides a balanced filter device comprising an unbalanced-side resonance electrode and a balanced-side resonance electrode, wherein the balanced filter device further comprises a stage constituting resonance electrode arranged adjacent to the unbalanced-side resonance electrode and/or the balanced-side resonance electrode, and the unbalanced-side resonance electrode and the balanced-side resonance electrode are arranged adjacent to each other.

With that arrangement, the balanced filter device having both the functions of a balun and a filter can be obtained with a simple structure. The stage constituting resonance electrode may be arranged adjacent to one or both of the unbalanced-side resonance electrode and the balanced-side resonance electrode. Preferably, the stage constituting resonance electrode is arranged adjacent to the balanced-side resonance electrode so that a high-attenuation filter effect is obtained.

Another embodiment provides a balanced filter device comprising an unbalanced-side resonance electrode and a balanced-side resonance electrode, wherein the balanced filter device further comprises a stage constituting resonance electrode arranged opposite to the unbalanced-side resonance electrode or the balanced-side resonance electrode, and the unbalanced-side resonance electrode and the balanced-side resonance electrode are arranged opposite to each other.

With that arrangement, the balanced filter device having both the functions of a balun and a filter can be obtained with a simple structure. The stage constituting resonance electrode may be arranged opposite to one or both of the unbalanced-side resonance electrode and the balanced-side resonance electrode. Preferably, the stage constituting resonance electrode is arranged opposite to the balanced-side resonance electrode so that a high-attenuation filter effect is obtained. In addition, the stage constituting resonance electrode may be arranged in entirely or partly opposite relation to the corresponding resonance electrode.

Another embodiment provides a balanced filter device comprising an unbalanced-side resonance electrode and a balanced-side resonance electrode, wherein the balanced filter device further comprises a stage constituting resonance electrode arranged adjacent to the unbalanced-side resonance electrode and/or the balanced-side resonance electrode, and the unbalanced-side resonance electrode, the balanced-side resonance electrode and the stage constituting resonance electrode are each formed of a strip-line.

With that arrangement, since electromagnetic coupling caused between the resonance electrodes is effectively utilized, the balanced filter device having both the functions of a balun and a filter can be obtained with a simple structure.

Another embodiment provides a balanced filter device being of a strip-line structure in which an unbalanced-side resonance electrode formed on a first dielectric layer and a balanced-side resonance electrode formed on a second dielectric layer are sandwiched between a pair of GND electrodes formed respectively on third and fourth dielectric layers, wherein the balanced filter device further comprises a stage constituting resonance electrode formed on a fifth dielectric layer, the unbalanced-side resonance electrode and the balanced-side resonance electrode are arranged opposite to each other, and the balanced-side resonance electrode and the stage constituting resonance electrode are arranged opposite to each other.

With that arrangement, since a balun and a filter are formed at the same time in a state partly sharing the resonance electrodes, the balanced filter device having both the functions of the balun and the filter can be obtained with a simple structure.

Some embodiments further comprise a coupling electrode formed on a sixth dielectric layer, the coupling electrode being arranged between the balanced-side resonance electrode and the stage constituting resonance electrode.

With that arrangement, since coupling between the balanced-side resonance electrode and the stage constituting resonance electrode is established by utilizing a laminated structure, a satisfactory filter band control effect can be obtained in the filter with a small-sized structure.

Another embodiment further comprises a DC electrode formed on a sixth dielectric layer, the DC electrode being arranged between the balanced side or unbalanced side resonance electrode and the GND electrodes.

With that arrangement, since a DC supply line is formed as an inner layer by utilizing a laminated structure, the balanced filter device including the DC supply line can be obtained with a simple structure.

As described above, some embodiments can provide the balanced filter having a small-sized structure and a high attenuation.

Further, another embodiment provides a balanced filter device comprising an unbalanced-side resonance electrode and a balanced-side resonance electrode, wherein a stage constituting resonance electrode having a shorted end at one end and an open end at the other end is arranged adjacent to the unbalanced-side resonance electrode and/or the balanced-side resonance electrode.

By thus arranging the resonance electrode having a shorted end at one end and an open end at the other end adjacent to the resonance electrode constituting a balun, the former resonance electrode is electromagnetically coupled to the resonance electrode constituting the balun. As a result, a trap is formed in a frequency characteristic and a band control effect can be obtained in the filter.

Another embodiment provides a balanced filter device comprising an unbalanced-side resonance electrode and a balanced-side resonance electrode, wherein the balanced filter device further comprises a stage constituting resonance electrode having a shorted end and an open end and being arranged adjacent to the unbalanced-side resonance electrode and/or the balanced-side resonance electrode, and the unbalanced-side resonance electrode and the balanced-side resonance electrode are arranged adjacent to each other.

With that arrangement, the balanced filter device having both the functions of a balun and a filter can be obtained with a simple structure. The stage constituting resonance electrode may be arranged adjacent to one or both of the unbalanced-side resonance electrode and the balanced-side resonance electrode. Preferably, the stage constituting resonance electrode is arranged adjacent to the balanced-side resonance electrode so that a high-attenuation filter effect is obtained.

Another embodiment provides a balanced filter device comprising an unbalanced-side resonance electrode and a balanced-side resonance electrode, wherein the balanced filter device further comprises a stage constituting resonance electrode having a shorted end and an open end and being arranged opposite to the unbalanced-side resonance electrode or the balanced-side resonance electrode, and the unbalanced-side resonance electrode and the balanced-side resonance electrode are arranged opposite to each other.

With that arrangement, the balanced filter device having both the functions of a balun and a filter can be obtained with a simple structure. The stage constituting resonance electrode may be arranged opposite to one or both of the unbalanced-side resonance electrode and the balanced-side resonance electrode. Preferably, the stage constituting resonance electrode is arranged opposite to the balanced-side resonance electrode so that a high-attenuation filter effect is obtained. In addition, the stage constituting resonance electrode may be arranged in entirely or partly opposite relation to the corresponding resonance electrode.

Another embodiment provides a balanced filter device comprising an unbalanced-side resonance electrode and a balanced-side resonance electrode, wherein the balanced filter device further comprises a stage constituting resonance electrode having a shorted end and an open end and being arranged adjacent to the unbalanced-side resonance electrode and/or the balanced-side resonance electrode, and the unbalanced-side resonance electrode, the balanced-side resonance electrode and the stage constituting resonance electrode are each formed of a strip-line.

With that arrangement, since electromagnetic coupling caused between the resonance electrodes is effectively utilized, the balanced filter device having both the functions of a balun and a filter can be obtained with a simple structure.

Another embodiment provides a balanced filter device being of a strip-line structure in which an unbalanced-side resonance electrode formed on a first dielectric layer and a balanced-side resonance electrode formed on a second dielectric layer are sandwiched between a pair of GND electrodes formed respectively on third and fourth dielectric layers, wherein the balanced filter device further comprises a stage constituting resonance electrode formed on a fifth dielectric layer having a shorted end and an open end, the unbalanced-side resonance electrode and the balanced-side resonance electrode are arranged opposite to each other, and the balanced-side resonance electrode and the stage constituting resonance electrode are arranged opposite to each other.

With that arrangement, the stage constituting resonance electrode is coupled to the resonance electrode constituting a balun, and a trap is fanned in a frequency characteristic. Therefore, the balanced filter device having both the functions of a balun and a filter can be obtained with a simple structure.

Some embodiments further comprise a wavelength shortening electrode formed on a sixth dielectric layer, wherein one end of the stage constituting resonance electrode is shorted through the wavelength shortening electrode.

With that arrangement, one end of the stage constituting resonance electrode can be shorted and a wavelength shortening effect can be obtained with the wavelength shortening electrode. Therefore, the filter having a small-sized structure and a satisfactory band control effect can be provided.

Another embodiment further comprises a DC electrode formed on a sixth dielectric layer, the DC electrode being arranged between the balanced side or unbalanced side resonance electrode and the GND electrodes and being connected to the balanced-side resonance electrode.

Another embodiment provides a balanced filter comprising an unbalanced-side resonance electrode and a balanced-side resonance electrode, the balanced filter device further comprising a stage constituting resonance electrode interposed between the unbalanced-side resonance electrode and the balanced-side resonance electrode; and a coupling electrode interposed between the unbalanced-side resonance electrode and the stage constituting resonance electrode and being arranged opposite to the electrodes.

By thus interposing the stage constituting resonance electrode between the unbalanced-side resonance electrode and the balanced-side resonance electrode, electromagnetic coupling caused between the resonance electrodes is effectively utilized. Therefore, the balanced filter device having both the functions of a balun and a filter can be obtained with a simple structure.

Further, by interposing the coupling electrode between the unbalanced-side resonance electrode and the stage constituting resonance electrode, the position of a trap formed at the lower frequency side in a pass band can be controlled without noticeably affecting the pass band. As a result, a larger attenuation rate can be obtained at a desired frequency.

Another embodiment provides a balanced filter comprising an unbalanced-side resonance electrode and a balanced-side resonance electrode, the balanced filter further comprising a stage constituting resonance electrode interposed between the unbalanced-side resonance electrode and the balanced-side resonance electrode; and a coupling electrode arranged opposite to the unbalanced-side resonance electrode, the unbalanced-side resonance electrode having two $\lambda/4$ strip-line portions formed by folding a strip-line having a length of $\lambda/2$ at a position where the $\lambda/2$ strip-line is divided into the two $\lambda/4$ strip-line portions, the coupling electrode coupling the two $\lambda/4$ strip-line portions to each other.

By thus coupling the two $\lambda/4$ strip-line portions constituting the unbalanced-side resonance electrode to each other, the position of a trap formed at the lower frequency side in a pass band can be satisfactorily controlled without noticeably affecting the pass band.

Another embodiment provides a balanced filter comprising an unbalanced-side resonance electrode and a balanced-side resonance electrode, the balanced filter further comprising a stage constituting resonance electrode interposed between the unbalanced-side resonance electrode and the balanced-side resonance electrode; and a coupling electrode arranged opposite to the stage constituting resonance electrode, the stage constituting resonance electrode being made up of two strip-lines each having a length of about $\lambda/4$, the coupling electrode coupling the two strip-lines to each other.

By thus coupling the two about-$\lambda/4$ strip-line portions constituting the stage constituting resonance electrode to each other, the position of a trap formed at the lower frequency side in a passage band can be satisfactorily controlled without noticeably affecting the passage band. In addition, by adjusting the length of the stage constituting resonance electrode in the range of $\lambda/4\pm\alpha$ as appropriate, an adjustment effect corresponding to $\pm\alpha$ can be obtained.

Some embodiments provide a balanced filter comprising an unbalanced-side resonance electrode and a balanced-side resonance electrode, the balanced filter further comprising a stage constituting resonance electrode interposed between the unbalanced-side resonance electrode and the balanced-side resonance electrode; and a coupling electrode arranged opposite to the unbalanced-side resonance electrode, the unbalanced-side resonance electrode having two $\lambda/4$ strip-line portions formed by folding a strip-line having a length of $\lambda/2$ at a position where the $\lambda/2$ strip-line is divided into the two $\lambda/4$ strip-line portions, the coupling electrode coupling the $\lambda/4$-divided position and a position closer to each end of the strip-line than the $\lambda/4$-divided position.

By thus coupling the $\lambda/4$-divided position of the unbalanced-side resonance electrode formed of the strip-line having the length of $\lambda/2$ and the position closer to each end of the strip-line than the $\lambda/4$-divided position, the position of a trap formed at the lower frequency side in a passage band can be satisfactorily controlled without noticeably affecting the passage band.

Another embodiment provides a balanced filter comprising an unbalanced-side resonance electrode and a balanced-side resonance electrode, the balanced filter further comprising a stage constituting resonance electrode interposed between the unbalanced-side resonance electrode and the balanced-side resonance electrode; and a coupling electrode arranged opposite to the stage constituting resonance electrode, the coupling electrode coupling a shorted-end side and an open-end side of the stage constituting resonance electrode to each other.

By thus coupling the shorted-end side and the open-end side of the stage constituting resonance electrode to each other, the position of a trap formed at the lower frequency side in a passage band can be satisfactorily controlled without noticeably affecting the passage band.

In the arrangements described above, the stage constituting resonance electrode is preferably arranged adjacent and opposite to both the unbalanced-side resonance electrode and the balanced-side resonance electrode so that a high-attenuation filter effect is obtained. The stage constituting resonance electrode may be arranged in entirely or partly opposite relation to the unbalanced-side resonance electrode and the balanced-side resonance electrode.

With that arrangement, since a DC supply line is formed as an inner layer by utilizing a laminated structure, the balanced filter device including the DC supply line can be obtained with a simple structure.

As described above, some embodiments provide the balanced filter having a small-sized structure and a high attenuation.

DESCRIPTION OF CERTAIN EMBODIMENTS

Embodiments of the present invention will be described in detail below with reference to the accompanying drawings. Note that the present invention is not limited to the following embodiments and can be modified as required.

Figure 1:
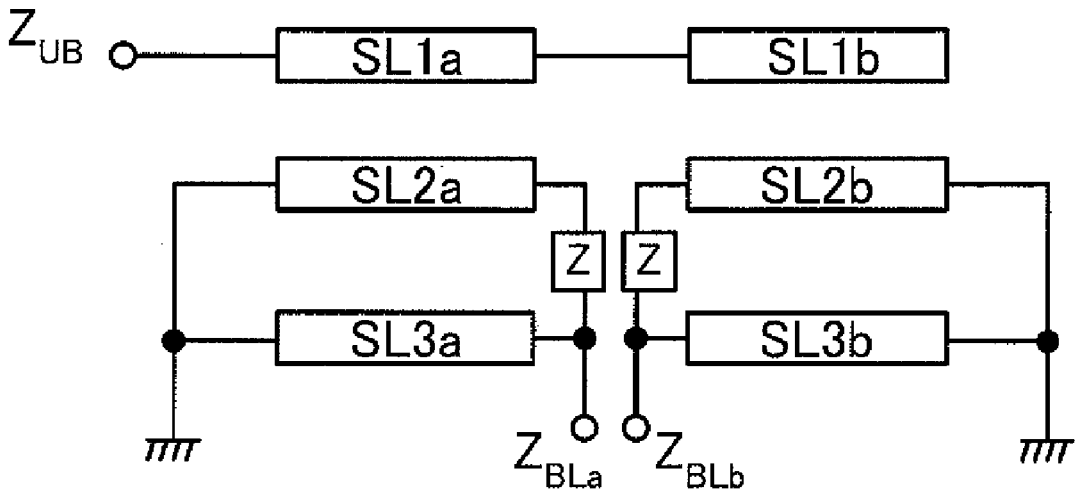
FIG. 1 is an equivalent circuit diagram showing features of a balanced filter according to one embodiment.

FIG. 1 is an equivalent circuit diagram showing features of a balanced filter according to one embodiment. As shown in FIG. 1, the balanced filter according to this embodiment comprises strip-line resonators SL1*a* and SL1*b* constituting resonance electrodes coupled to an unbalanced terminal, strip-line resonators SL2*a* and SL2*b* constituting resonance electrodes coupled to balanced side terminals through an impedance element, and strip-line resonators SL3*a* and SL3*b* constituting resonance electrodes coupled directly to the balanced side input/output terminals. The impedance elements Z also couple the resonance electrodes SL2*a* and SL2*b* to the resonance electrodes SL3*a* and SL3*b*.

The unbalanced-side resonance electrodes SL1*a* and SL are each formed of a λ/4 strip-line. As shown in FIG. 1, those strip-lines are connected to each other at their one ends. Then, the other end of the unbalanced-side resonance electrode SL1*a* is connected to an unbalanced terminal $Z_{UB}$, and the other end of the unbalanced-side resonance electrode SL1*b* is constituted as an open end.

The balanced-side resonance electrodes SL2*a* and SL2*b* are each formed of a λ/4 strip-line shorted at one end. As shown in FIG. 1, the balanced-side resonance electrodes SL2*a* and SL2*b* are arranged adjacent to the unbalanced-side resonance electrodes SL1*a* and SL1*b*, respectively.

The resonance electrodes SL3*a* and SL3*b* are also each formed of a strip-line shorted at one end. As shown in FIG. 1, the resonance electrodes SL3*a* and SL3*b* are arranged adjacent to the resonance electrodes SL2*a* and SL2*b*, respectively.

Each of these stage constituting resonance electrodes SL3*a* and SL3*b* has a length decided with impedance adjustment on the basis of λ/4.

The resonance electrodes SL2*a* and SL2*b* and the resonance electrodes SL3*a* and SL3*b* are constituted in comb-line arrangement in which the open ends and the shorted ends of the resonators are laid to face in the same direction, and every pairs of those electrodes are connected to each other at the open end side through the impedance elements Z. Further, the open ends of those electrodes are connected to balanced terminal $Z_{BLa}$ and $Z_{BLb}$.

As a result, the balun function and the filter function can be obtained with the structure in which the balanced-side resonance electrodes SL2*a* and SL2*b* are shared by the balun section and the filter section. Hence, a balanced filter having a simple structure, a small size and a low cost can be realized.

Figure 2:
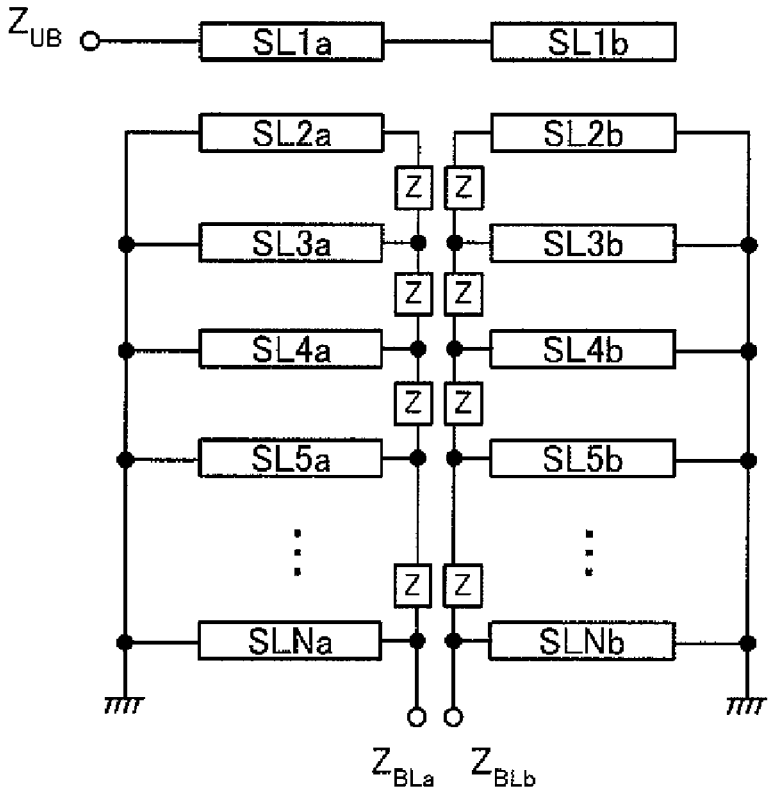
FIG. 2 is an equivalent circuit diagram showing an example in which the balanced filter shown in FIG. 1 is constructed in multiple stages.

FIG. 2 is an equivalent circuit diagram showing an example in which the balanced filter shown in FIG. 1 is constructed in multiple stages. When it is desired to enhance the filter function of the balanced filter shown in FIG. 1, resonance electrodes SL4*a*, SL4*b*-SLNa, SLNb may be added in multistage arrangement with impedance elements Z disposed between the adjacent electrodes, as shown in FIG. 2.

Figure 3:
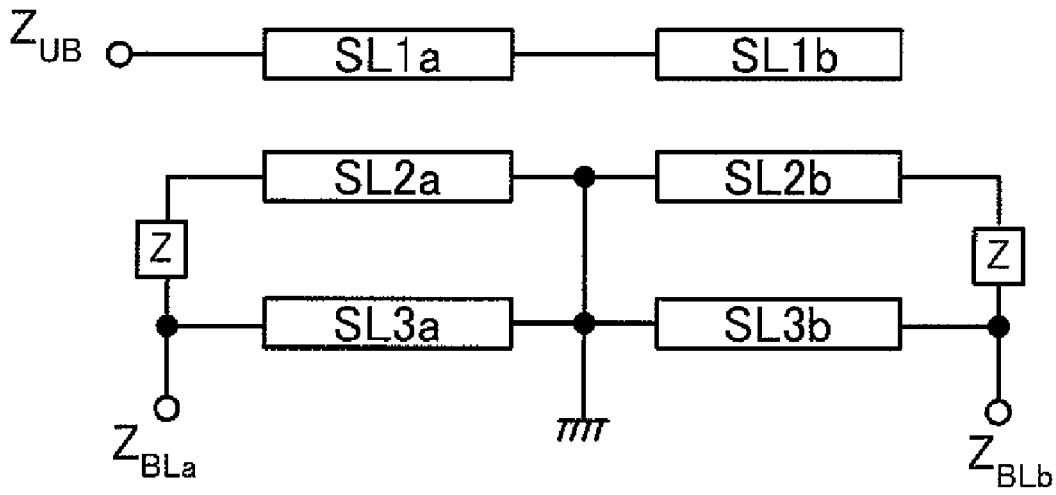
FIG. 3 is an equivalent circuit diagram showing an example in which a shorted end and an open end of the balanced filter shown in FIG. 1 are changed in directions to face.

FIG. 3 is an equivalent circuit diagram showing an example in which a shorted end and an open end of the balanced filter shown in FIG. 1 are changed in directions to face. As shown in FIG. 3, the resonance electrodes SL3*a* and SL3*b* may be shorted at the junction between them, and those resonance electrodes SL3*a* and SL3*b* may be connected at outer ends to balanced terminals $Z_{BLa}$ and $Z_{BLb}$, respectively. In this case, the resonance electrodes SL2*a* and SL2*b* are also shorted at the junction between them corresponding to the balanced-side resonance electrodes, and those resonance electrodes SL2*a* and SL2*b* are connected at outer ends to the balanced-side terminals through impedance elements Z.

Figure 4:
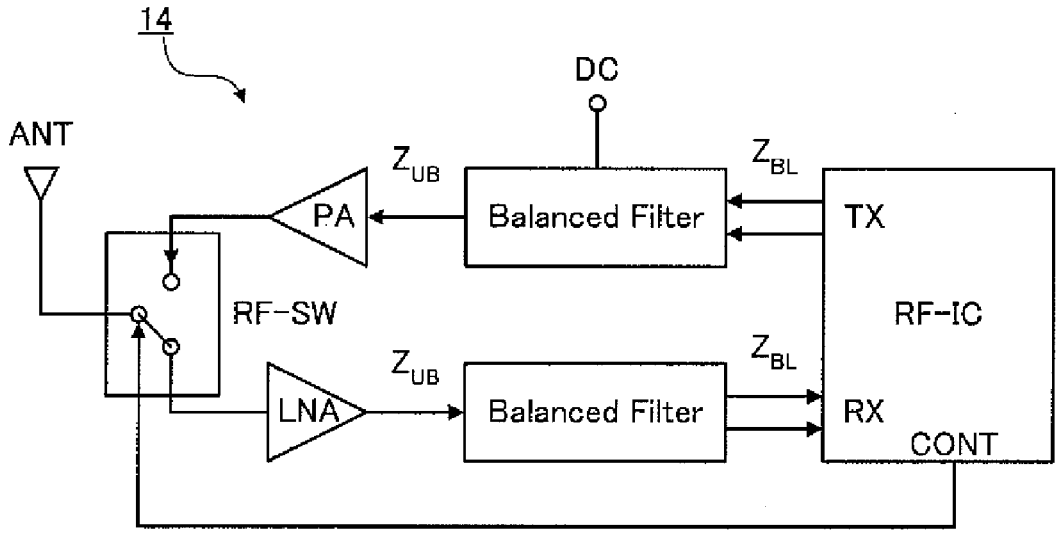
FIG. 4 is a circuit block diagram showing the configuration of an RF front end section in which the balanced filter according to one embodiment is assembled.

FIG. 4 is a circuit block diagram showing the configuration of an RF front end section in which the balanced filter according to one embodiment is assembled. In a radio communication circuit 14 shown in FIG. 4, the balanced filter is assembled in each of a transmitting path TX and a receiving path RX, and DC power is supplied to the balanced filter arranged on the transmitting path TX side.

As shown in FIG. 4, the radio communication circuit 14 comprises an antenna (ANT) for transmitting and receiving electric waves, an RF switch (RF-SW) for switching over the transmitting path TX and the receiving path RX, a power amplifier (PA) for amplifying a signal in the transmitting path TX, a low-noise amplifier (LNA) for amplifying a signal in the receiving path RX, the balanced filter disposed in each of the transmitting path TX and the receiving path RX, and an integrated circuit (RF-IC) for generating and processing an RF signal. The switching between the transmitting path TX and the receiving path RX is performed in response to a signal outputted from a control port (CONT) of the integrated circuit (RF-IC).

A signal received by the antenna (ANT) is inputted to the balanced filter in the form of an unbalanced signal on the basis of the GND potential via the RF switch (RF-SW) and the low-noise amplifier (LNA). The balanced filter converts the unbalanced signal to the balanced signal having a phase difference of 180°, and the converted balanced signal is inputted to a receiving port RX of the integrated circuit (RF-IC).

On the other hand, a transmission signal generated from the integrated circuit (RF-IC) is inputted in the form of a balanced signal to the transmitting-side balanced filter from a transmitting port TX. The transmitting-side balanced filter converts the balanced signal to an unbalanced signal with a DC bias applied to the balanced terminal. The converted unbalanced signal is radiated from the antenna (ANT) via the power amplifier (PA) and the RF switch (RF-SW).

While the example shown in FIG. 4 has been described as adding a DC signal to the balun disposed in the transmitting path TX, the DC signal may be added to the receiving path RX side depending on the specification of the radio communication circuit. Alternatively, the circuit configuration may be modified such that the DC signal is not added to both the transmitting and receiving paths.

Figure 5:
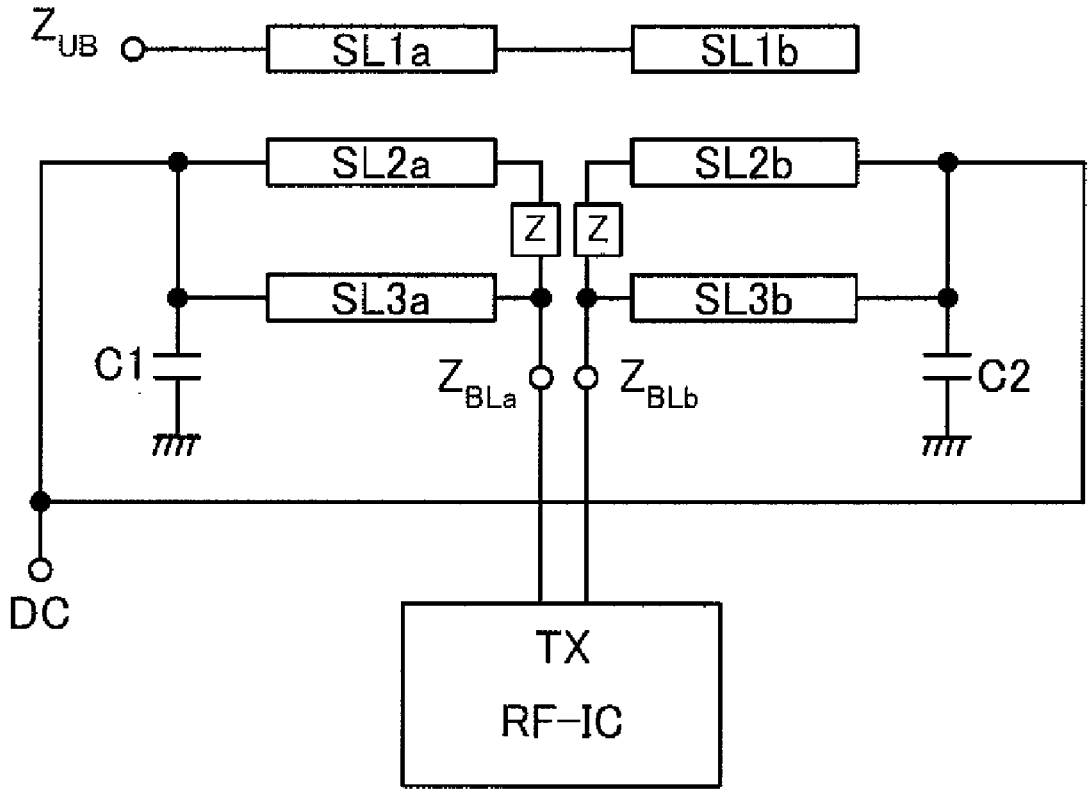
FIG. 5 is a circuit block diagram showing an equivalent circuit of a transmitting-side balanced filter shown in FIG. 4.

FIG. 5 is a circuit block diagram showing an equivalent circuit of the transmitting-side balanced filter shown in FIG. 4. As shown in FIG. 5, the transmitting-side balanced filter supplied with the DC signal comprises strip-line resonators SL1*a* and SL1*b* constituting resonance electrodes on the unbalanced side, strip-line resonators SL2*a*,SL2*b*, SL3*a* and SL3*b* on the balanced side, and capacitors C1 and C2 for bypassing AC signals. Then, the transmitting-side balanced filter is connected at the unbalanced terminal side to the power amplifier (PA), shown in FIG. 4, via an unbalanced terminal $Z_{UB}$, and is connected at the balanced terminal side to the integrated circuit (RF-IC) via balanced terminals $Z_{BLa}$ and $Z_{BLb}$.

Figure 6:
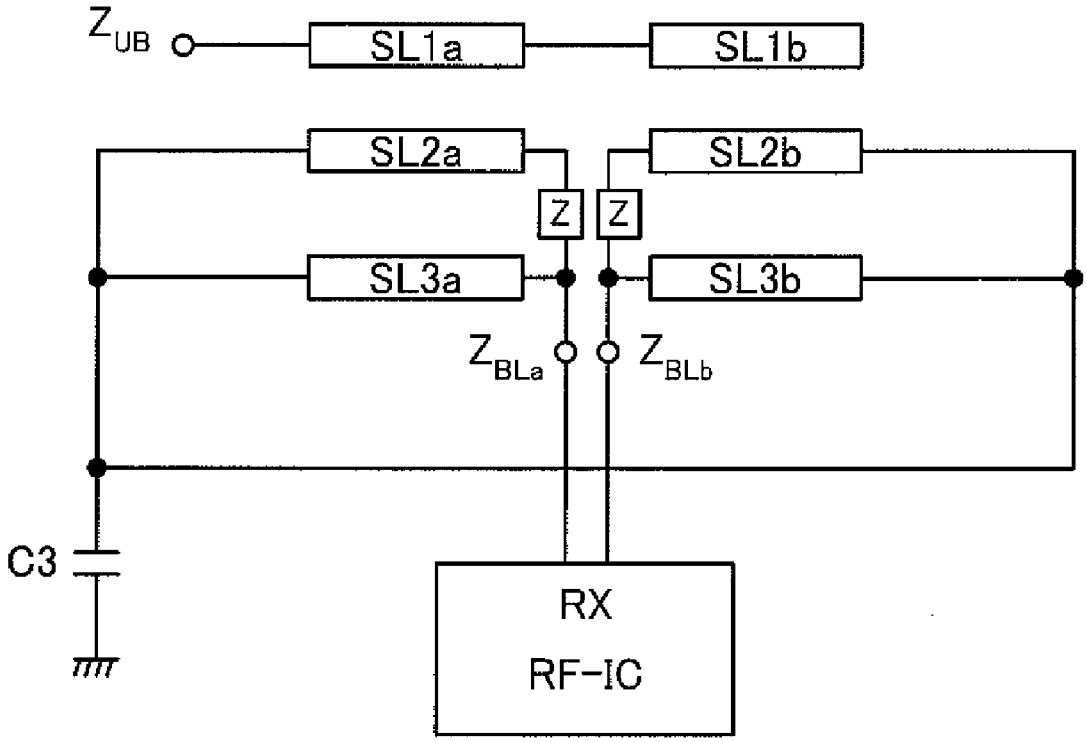
FIG. 6 is a circuit block diagram showing an equivalent circuit of a receiving-side balanced filter shown in FIG. 4.

FIG. 6 is a circuit block diagram showing an equivalent circuit of the receiving-side balanced filter shown in FIG. 4. As shown in FIG. 6, the receiving-side balanced filter is constituted such that the DC supply section is omitted from the transmitting-side balanced filter shown in FIG. 5 and a capacitor C3 for adjusting characteristics is disposed instead of the capacitors C1 and C2 for bypassing AC signals.

Figure 7:
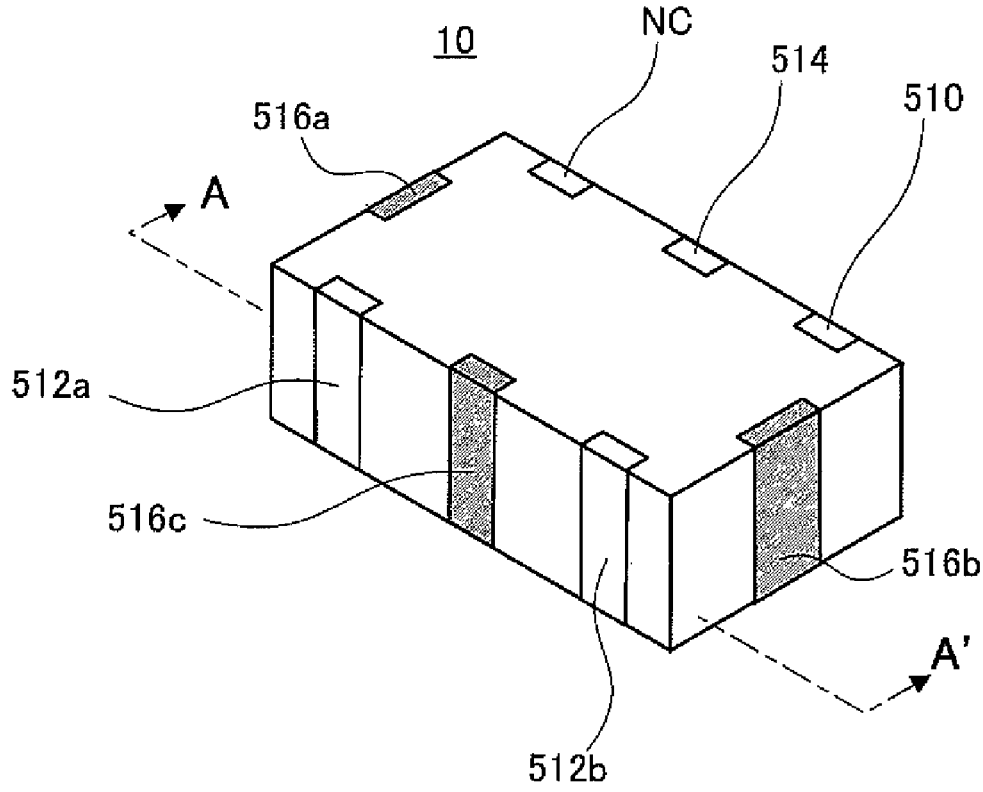
FIG. 7 is a perspective view showing, in external appearance, the structure of the balanced filter according to one embodiment.

FIG. 7 is a perspective view showing, in external appearance, the structure of the balanced filter according to one embodiment. As shown in FIG. 7, a balanced filter 10 of this embodiment has, as external terminal electrodes, an unbalanced terminal 510, balanced terminals 512*a* and 512*b*, a DC terminal 514, and GND terminals 516*a*, 516*b* and 516*c*. Additionally, a terminal denoted by "NC" in FIG. 7 is an unconnected terminal. Because the unbalanced-side resonance electrodes formed inside the balanced filter is arranged in symmetrical shape between the NC terminal and the unbalanced terminal 510, the unbalanced terminal 510 and the NC terminal can be used in a replaceable manner.

Figure 8:
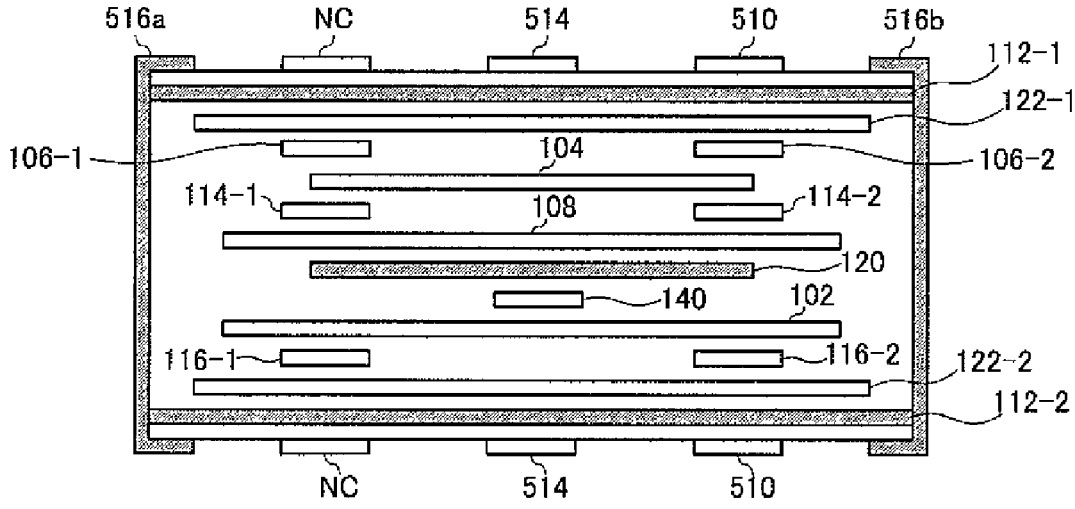
FIG. 8 is a sectional view showing an embodiment of a balanced filter.

FIG. 8 is a sectional view showing one embodiment of a balanced filter. The balanced filter shown in FIG. 8 has a strip-line structure in which a resonance electrode 102 connected to an unbalanced terminal 510, a balanced-side resonance electrode 104 connected directly to balanced terminals 512*a*, 512*b*, and a resonance electrode 108 connected to the balanced terminals 512*a*, 512*b* through impedance elements formed on respective dielectric layers in laminated arrangement between GND electrodes 112-1 and 112-2 which are connected respectively to the GND terminals 516*a*, 516*b*.

In that structure, the unbalanced-side resonance electrode 102 and the balanced-side resonance electrode 104 are formed in adjacently opposed relation with the dielectric layer interposed between them, and the resonance electrode 108 is arranged between those electrodes 102 and 104, thereby constituting a balanced filter in which strip-line resonance electrodes are laminated in the opposed multistage form.

Also, a trap control coupling electrode 140 is arranged between the resonance electrode 108 and the unbalanced-side resonance electrode 102, and the coupling action of the trap control coupling electrode 140 controls the position of a trap that is formed at the lower-frequency side in the passage band.

Further, an intermediate electrode 122-1 and electrodes 106-1, 106-2 are arranged between the GND electrode 112 and the balanced-side resonance electrode 104, and another electrode 114 is arranged between the balanced-side resonance electrode 104 and the resonance electrode 108. An electrode 120 is arranged between the electrode 108 and the trap control coupling electrode 140. Additional electrodes 116-1 and 116-2 and an intermediate electrode 122-2 are arranged between the unbalanced-side resonance electrode 102 and the GND electrode 112-2.

Figure 9:
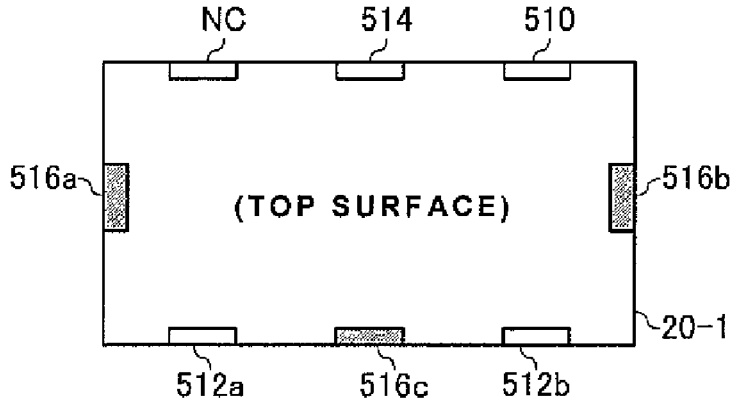
FIG. 9 is a first exploded plan view showing the arrangement of electrodes in layers of the balanced filter shown in FIG. 8.
Figure 9:
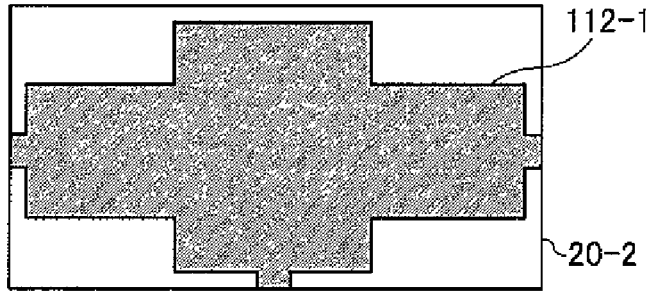

Additionally, the unbalanced-side resonance electrode 102 is connected to an unbalanced terminal 510, and the balanced-side resonance electrode 104 is connected to balanced terminals 512*a*, 512*b* shown in FIG. 9. The GND electrodes 112-1 and 112-2 are connected to GND terminals 516*a*, 516*b*, and 516*c*, and the DC electrode 110 is connected to the DC terminal 514.

FIG. 9 is a first exploded plan view showing the arrangement of electrodes in layers of the balanced filter shown in FIG. 8. As shown at (a) in FIG. 9, an unconnected terminal NC, the DC terminal 514, the unbalanced terminal 510, the balanced terminals 512*a* and 512*b*, and the GND terminals 516*a*-516*c* are formed on a first dielectric layer 20-1, thereby constituting a top surface of the modified balanced filter.

Also, as shown at (b) in FIG. 9, the GND electrode 112-1 is formed on a second dielectric layer 20-2 in contact with the GND terminals 516*a*-516*c*, and the second dielectric layer 20-2 is arranged under the first dielectric layer 20-1 shown in FIG. 9(*a*).

Figure 10:
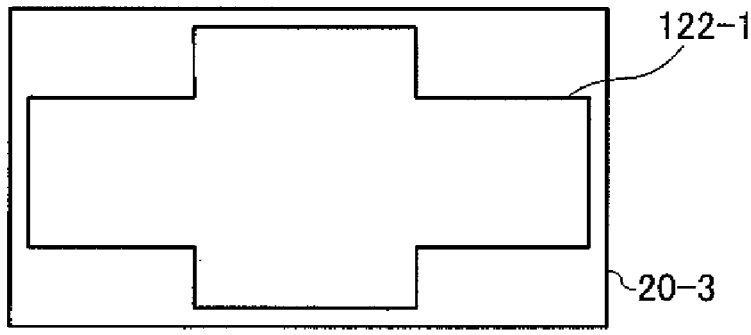
FIG. 10 is a second exploded plan view showing the arrangement of electrodes in layers of the balanced filter shown in FIG. 8.
Figure 10:
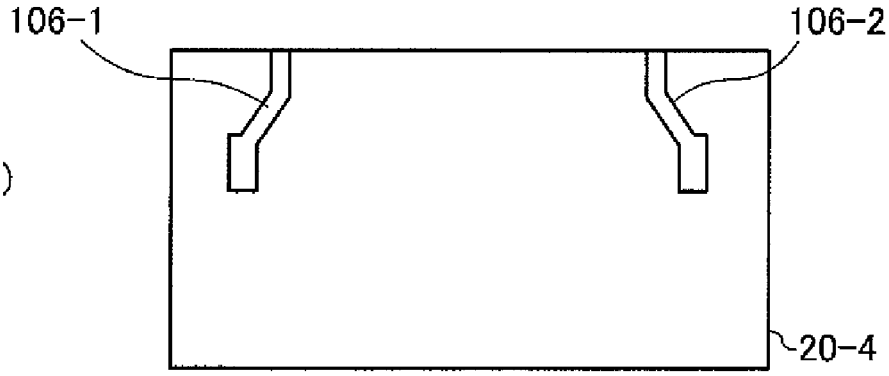

FIG. 10 is a second exploded plan view showing the arrangement of electrodes in layers of the balanced filter shown in FIG. 8. As shown at (a) in FIG. 10, the intermediate electrode 122-1 is formed on a third dielectric layer 20-3 in position and shape opposed to the GND electrode 112-1 shown in FIG. 9(*b*).

Also, as shown at (b) in FIG. 10, electrodes 106-1 and 106-2 connected respectively to the terminals NC and 510 are formed on a fourth dielectric layer 20-4, and the fourth dielectric layer 20-4 is arranged under the third dielectric layer 20-3 shown in FIG. 9(*a*).

Figure 11:
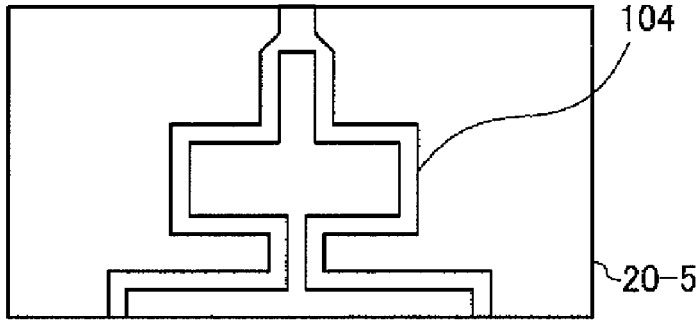
FIG. 11 is a third exploded plan view showing the arrangement of electrodes in layers of the balanced filter shown in FIG. 8.
Figure 11:
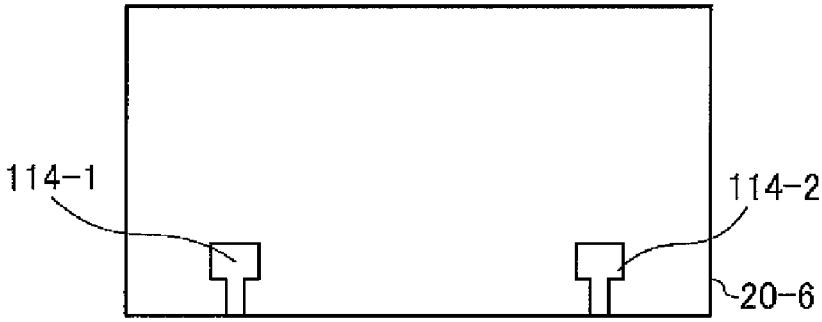

FIG. 11 is a third exploded plan view showing the arrangement of electrodes in layers of the balanced filter shown in FIG. 8. As shown at (a) in FIG. 11, the balanced-side resonance electrode 104 made up of two strip-lines is formed on a fifth dielectric layer 20-5, each of the strip-lines being formed to extend in length of $\lambda/4$ from the DC terminal 514. The fifth dielectric layer 20-5 is arranged under the fourth dielectric layer 20-4 shown in FIG. 10(*b*).

Also, as shown at (b) in FIG. 11, electrodes 114-1 and 114-2 connected respectively to the balanced terminals 512*a* and 512*b* are formed on a sixth dielectric layer 20-6, and the sixth dielectric layer 20-6 is arranged under the fifth dielectric layer 20-5 shown in FIG. 11(*a*).

Figure 12:
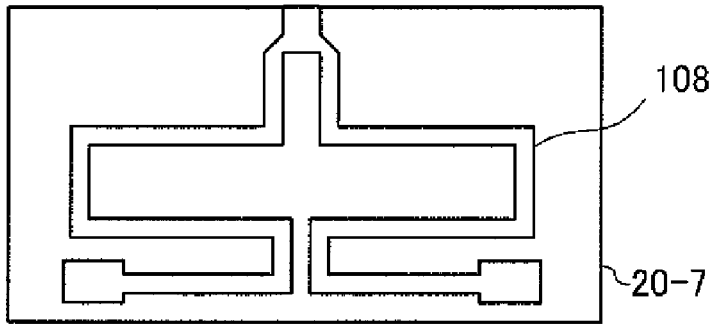
FIG. 12 is a fourth exploded plan view showing the arrangement of electrodes in layers of the balanced filter shown in FIG. 8.
Figure 12:
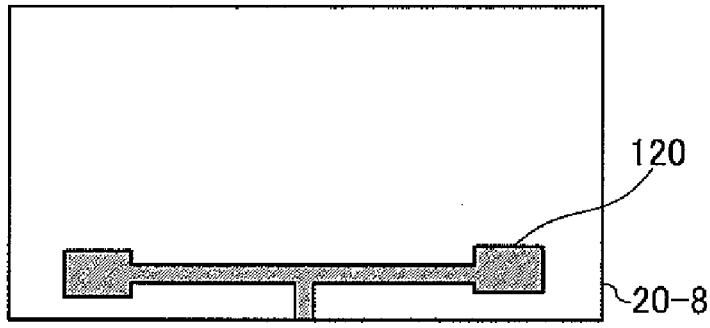

FIG. 12 is a fourth exploded plan view showing the arrangement of electrodes in layers of the balanced filter shown in FIG. 8. As shown at (a) in FIG. 12, the resonance electrode 108 made up of two strip-lines is formed on a seventh dielectric layer 20-7 in a state not connected to the balanced terminals 512*a* and 512*b*, each of the strip-lines being formed to extend in length of $\lambda/4\pm\alpha$ from the DC terminal 514. The seventh dielectric layer 20-7 is arranged under the sixth dielectric layer 20-6 shown in FIG. 11(*b*).

Also, as shown at (b) in FIG. 12, the electrode 120 connected to the GND terminal 516*c* is formed on an eighth dielectric layer 20-8, shown in FIG. 12(*a*), in position and shape opposed to the open-end side of the resonance electrode 108. The eighth dielectric layer 20-8 is arranged under the seventh dielectric layer 20-7 shown in FIG. 12(*a*).

Figure 13:
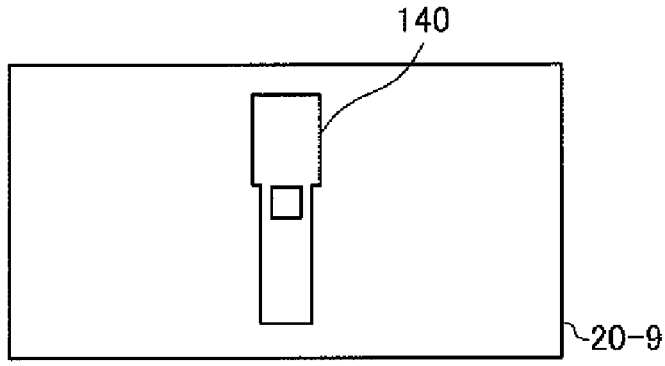
FIG. 13 is a fifth exploded plan view showing the arrangement of electrodes in layers of the balanced filter shown in FIG. 8.
Figure 13:
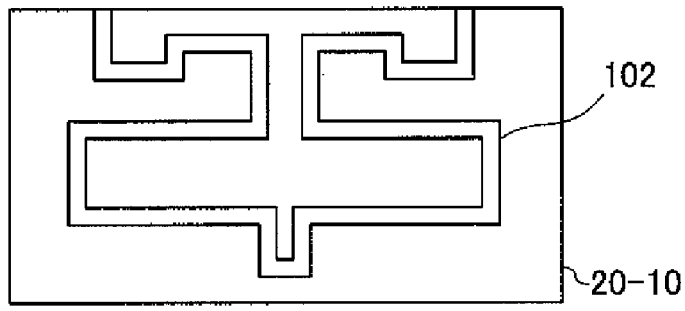

FIG. 13 is a fifth exploded plan view showing the arrangement of electrodes in layers of the balanced filter shown in FIG. 8. As shown at (a) in FIG. 13, the trap control coupling electrode 140 is formed on a ninth dielectric layer 20-9 in position and shape establishing coupling the two strip-lines of the resonance electrode 108, shown in FIG. 12(*a*), at both positions of the shorted end side and the open end side thereof. The ninth dielectric layer 20-9 is arranged under the eighth dielectric layer 20-8 shown in FIG. 12(*b*).

Also, as shown at (b) in FIG. 13, the unbalanced-side resonance electrode 102 having a length of $\lambda/2$ is formed on a tenth dielectric layer 20-10 in junction with the NC terminal and the unbalanced terminal 510, and the tenth dielectric layer 20-10 is arranged under the ninth dielectric layer 20-9 shown in FIG. 13(*a*).

Figure 14:
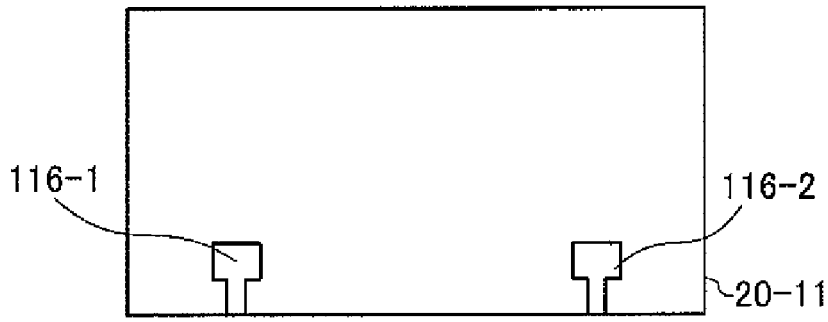
FIG. 14 is a sixth exploded plan view showing the construction of electrodes in layers of the balanced filter shown in FIG. 8.
Figure 14:
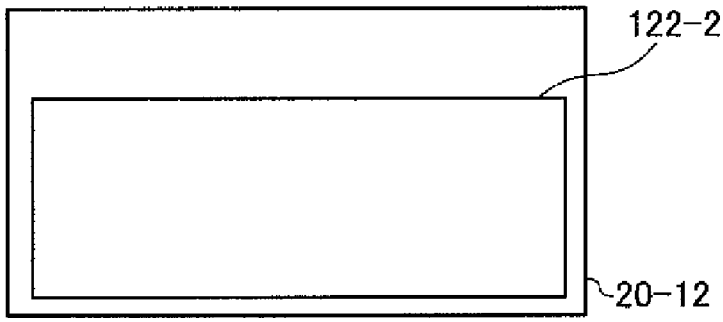

FIG. 14 is a sixth exploded plan view showing the arrangement of electrodes in layers of the balanced filter shown in FIG. 8. As shown at (a) in FIG. 14, electrodes 116-1 and 116-2 connected to the balanced terminals 512*a* and 512*b*, respectively, are formed on an eleventh dielectric layer 20-11, and the eleventh dielectric layer 20-11 is arranged under the tenth dielectric layer 20-10 shown in FIG. 13(*b*).

Figure 15:
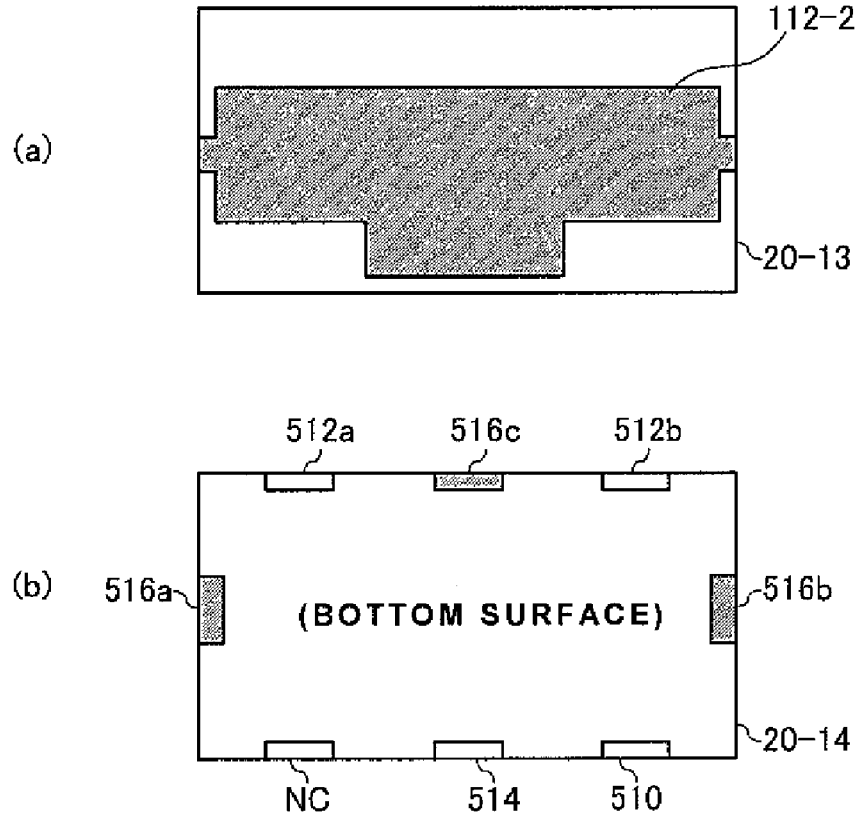
FIG. 15 is a seventh exploded plan view showing the construction of electrodes in layers of the balanced filter shown in FIG. 8.

Also, as shown at (b) in FIG. 14, the intermediate electrode 122-2 is formed on a twelfth dielectric layer 20-12 in position and shape opposed to the GND electrode 112-2 shown in FIG. 15(*a*). FIG. 15 is a seventh exploded plan view showing the arrangement of electrodes in layers of the balanced filter shown in FIG. 8. As shown at (a) in FIG. 15, The GND electrode 112-2 connected to the GND terminals 516*a*-516*c* is formed on a thirteenth dielectric layer 20-13, and the thirteenth dielectric layer 20-13 is arranged under the twelfth dielectric layer 20-12 shown in FIG. 14(*b*).

Also, as shown at (b) in FIG. 15, the balanced terminals 512*a* and 512*b*, the GND terminals 516*a*-516*c*, the unconnected terminal NC, the DC terminal 514, and the unbalanced terminal 510 are formed on a fourteenth dielectric layer 20-14, thereby constituting a bottom surface of the modified balanced filter. The fourteenth dielectric layer 20-14 is arranged under the thirteenth dielectric layer 20-13 shown in FIG. 15(*a*).

The dielectric layers 20-1 to 20-14 are formed into an integral structure through stacking and baking steps, thus completing the balanced filter in the laminated form made up of the plurality of dielectric layers. The external electrode terminals denoted by 510-516 in the drawings are preferably formed by coating or plating after the stacking and baking steps. Other suitable intermediate layers may be interposed between the dielectric layers 20-1 to 20-14, as required.

Figure 16:
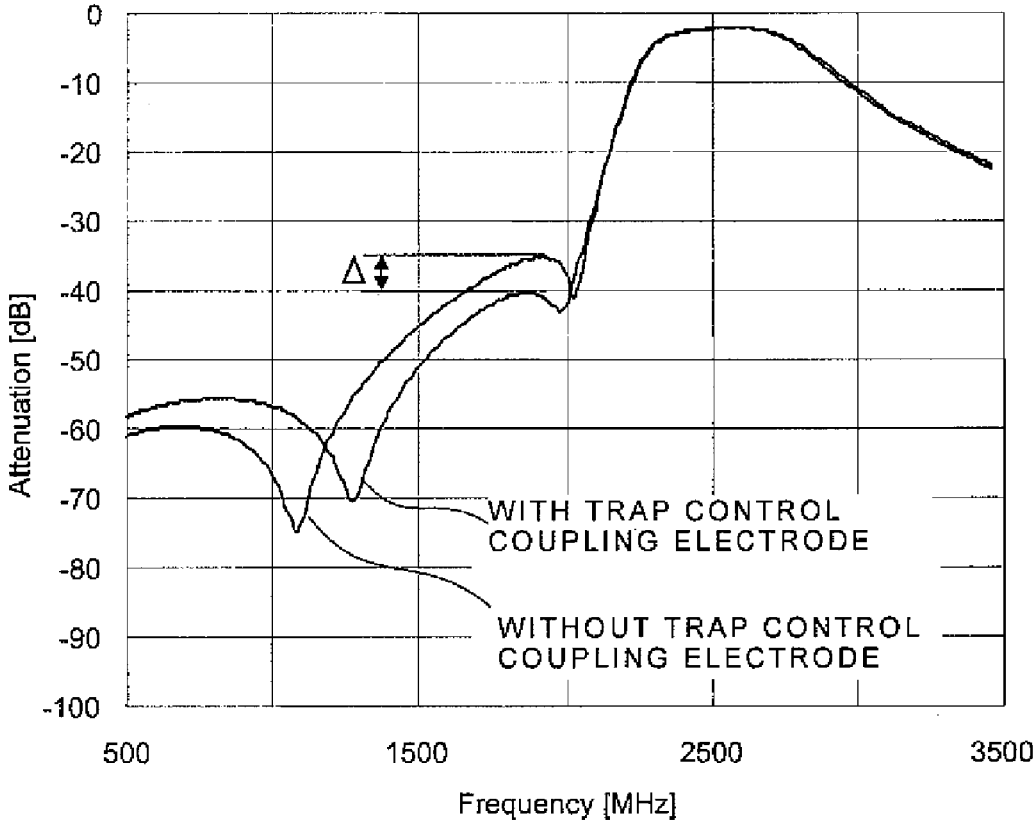
FIG. 16 is a characteristic graph showing an effect resulting with the provision of a trap control coupling electrode 140 shown in FIG. 8 is disposed.

FIG. 16 is a characteristic graph showing an effect resulting from providing the trap control coupling electrode 140 shown in FIG. 8. As shown in FIG. 16, with the provision of the trap control coupling electrode 140 between the unbalanced-side resonance electrode 102 and theresonance electrode 108, a trap formed at the lower-frequency side in the band of 1 GHz-1.5 GHz can be shifted closer to the passage band. As a result, an attenuation rate near 1.9 GHz, which is utilized as another communication band, can be increased $\Delta$, as shown, in comparison with the case not providing the trap control coupling electrode 140.

Figure 17:
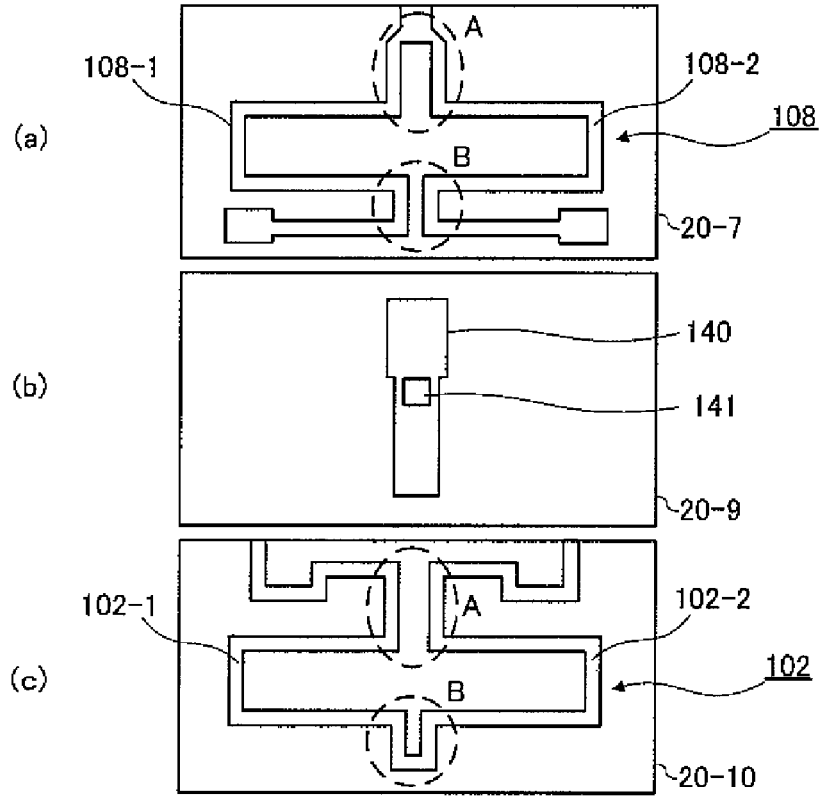
FIG. 17 is an exploded plan view showing the opposing relationship among the trap control coupling electrode 140, a stage constituting resonance electrode 108, and an unbalanced-side resonance electrode 102 shown in FIG. 8.

FIG. 17 is an exploded plan view showing the opposing relationship among the trap control coupling electrode 140, the resonance electrode 108, and the unbalanced-side resonance electrode 102 shown in FIG. 8. As seen from FIG. 17, the trap control coupling electrode 140 shown at (b) in FIG. 17 is arranged between the resonance electrode 108 shown at (a) in FIG. 17 and the unbalanced-side resonance electrode 102 shown at (c) in FIG. 17 to establish coupling in and/or between portions of the respective strip-lines, indicated by dotted lines A, B, thereby providing the trap control effect described above with reference to FIG. 16.

As shown in FIG. 17(*a*), the resonance electrode 108 is made up of two strip-lines 108-1 and 108-2 each formed to extend in length of $\lambda/4\pm\alpha$ from the DC terminal 514. Assuming that one side of each strip-line connected to the DC terminal 514 is a shorted end and the opposite side thereof is an open end, the portion indicated by the dotted line A in FIG. 17(*a*) serves to establish coupling of both the strip-lines 108-1 and 108-2 at the shorted end side, and the portion indicated by the dotted line B serves to establish coupling of both the strip-lines 108-1 and 108-2 at the open end side.

Thus, a satisfactory trap control effect can be obtained by coupling the two strip-lines, which constitute the resonance electrode 108, at both shorted end side and the open end side. Incidentally, as shown in FIG. 17(*a*), the strip-lines 108-1 and 108-2 of theresonance electrode 108 are formed in such a pattern shape that they come close to each other in the portions indicated by the dotted lines A and B.

Also, as shown in FIG. 17(*c*), the unbalanced-side resonance electrode 102 is formed in a state where one strip-line having a length of $\lambda/2$ is formed at its both ends to the NC terminal and the unbalanced terminal 510. Looking at the one $\lambda/2$ strip-line with a middle point (i.e., a $\lambda/4$ point from each end) being a base point, it can be said that the one $\lambda/2$ strip-line is made up of two strip-lines 102-1 and 102-2.

Accordingly, the trap control coupling electrode 140 shown in FIG. 17(*b*) establishes coupling in and/or between the portion indicated by the dotted line B, which corresponds to the middle position of the $\lambda/2$ strip-line shown in FIG. 17(*c*), and the portion indicated by the dotted line A, which corresponds to respective parts of the strip-lines 102-1 and 102-2 positioned opposite to the middle position of the $\lambda/2$ strip-line. By thus coupling the two strip-lines constituting the unbalanced-side resonance electrode 102 at the middle position of $\lambda/2$ and a position opposed thereto, a satisfactory trap control effect can be obtained. Incidentally, as shown in FIG. 17(*c*), the strip-lines 102-1 and 102-2 constituting the unbalanced-side resonance electrode 102 are formed in such a pattern shape that they come close to each other in the portions indicated by the dotted lines A and B.

In addition, as shown in FIG. 17(*b*), an opening 141 is formed in the trap control coupling electrode 140 in a connecting area between the dotted-line portions A and B shown in FIGS. 17(*a*) and 17(*c*). The opening 141 has the functions of not only shunting a current path, but also adjusting the trap position.

Figure 18:
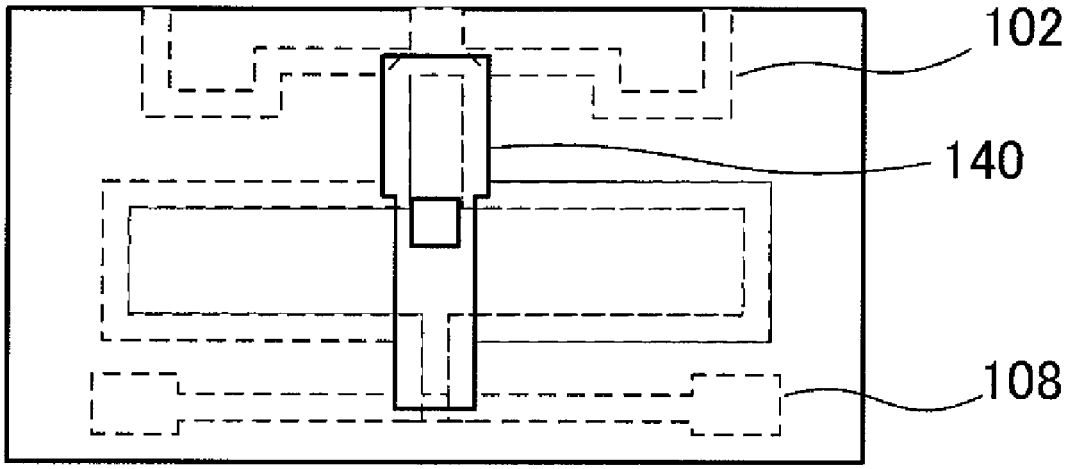
FIG. 18 is a seeing-through plan view showing the opposing relationship among the trap control coupling electrode 140, the stage constituting resonance electrode 108, and the unbalanced-side resonance electrode 102 shown in FIG. 8.

FIG. 18 is a seeing-through plan view showing the opposing relationship among the trap control coupling electrode 140, the resonance electrode 108, and the unbalanced-side resonance electrode 102 shown in FIG. 8. As shown in FIG. 18, the trap control coupling electrode 140 is disposed in a position capable of establishing the coupling in and/or between the dotted-line portions A and B of the unbalanced-side resonance electrode 102 and the resonance electrode 108 shown in FIG. 17.

Figure 19:
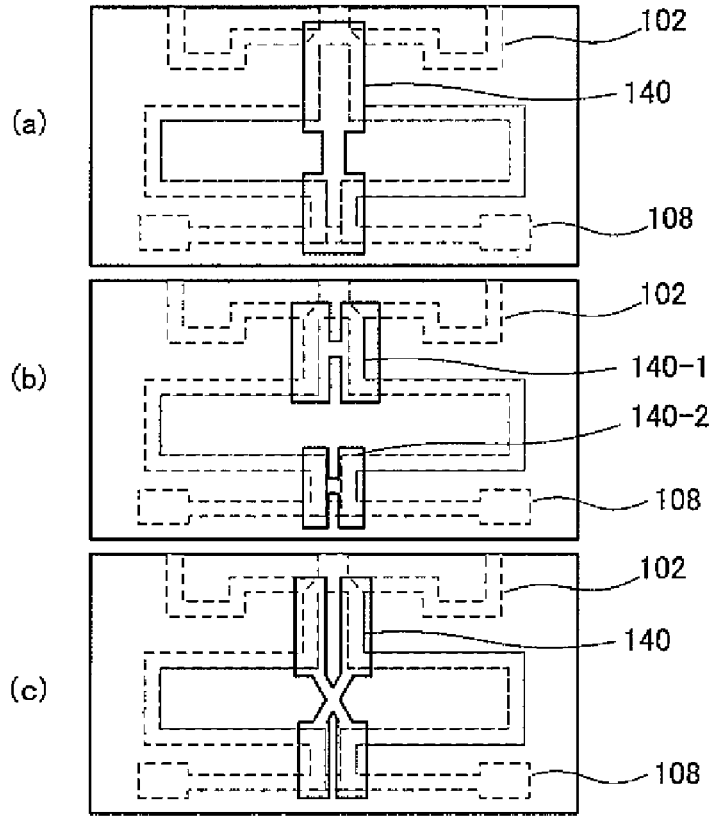
FIG. 19 is a seeing-through plan view showing another example of the trap control coupling electrode shown in FIG. 18.

FIG. 19 is a seeing-through plan view showing another example of the trap control coupling electrode shown in FIG. 18. As shown at (a) in FIG. 19, the trap control coupling electrode may be formed to couple the dotted-line portions A and B shown in FIG. 17 through a single narrow pattern. Alternatively, as shown at (b) in FIG. 19, the trap control coupling electrode may be formed such that the coupling is independently established through a single narrow pattern in each of the dotted-line portions A and B. Further, as shown at (c) in FIG. 19, the trap control coupling electrode may be formed such that the left strip-line located in the dotted-line portion A shown in FIG. 17 is coupled to the right strip-line located in the dotted-line portion B through a first oblique narrow pattern, and the right strip-line located in the dotted-line portion A is coupled to the left strip-line located in the dotted-line portion B through a second oblique narrow pattern.

Figure 20:
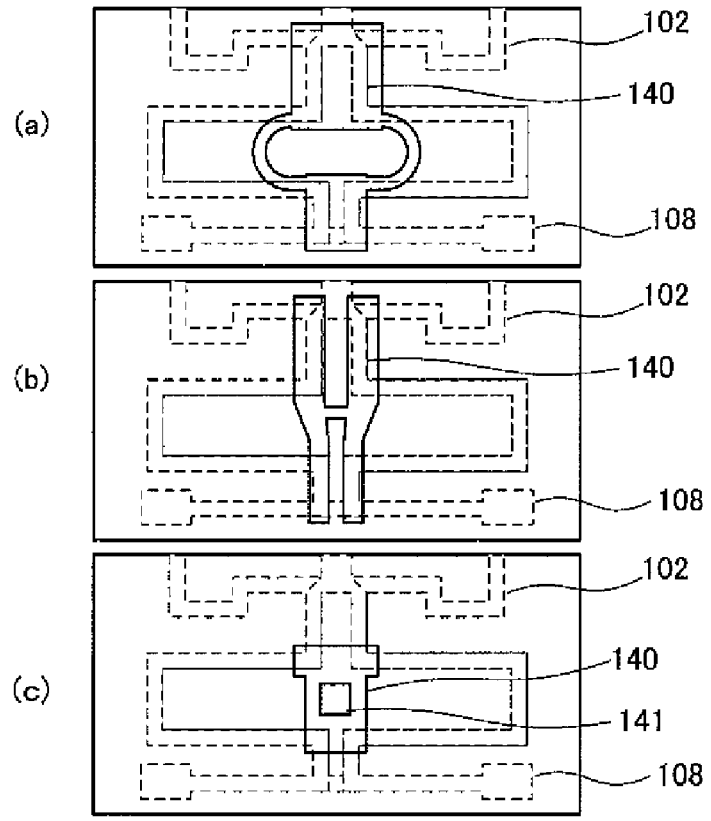
FIG. 20 is a seeing-through plan view showing still another example of the trap control coupling electrode shown in FIG. 18.

FIG. 20 is a seeing-through plan view showing still other examples of the trap control coupling electrode shown in FIG. 18. As shown at (a) in FIG. 20, the trap control coupling electrode may be formed to couple the dotted-line portions A and B shown in FIG. 17 through two curved narrow patterns separately bridging the left and right strip-lines in each side. Alternatively, as shown at (b) in FIG. 20, the trap control coupling electrode may be formed such that the dotted-line portions A and B shown in FIG. 17 are coupled by two independent lines extending in left and right sides, respectively, and those coupling lines are connected to each other at their midpoints. Furthermore, as shown at (c) in FIG. 20, the trap control coupling electrode may be formed in partly overlapped relation to the dotted-line portions A and B shown in FIG. 17 with an opening formed in a central portion of the coupling electrode.

Figure 21:
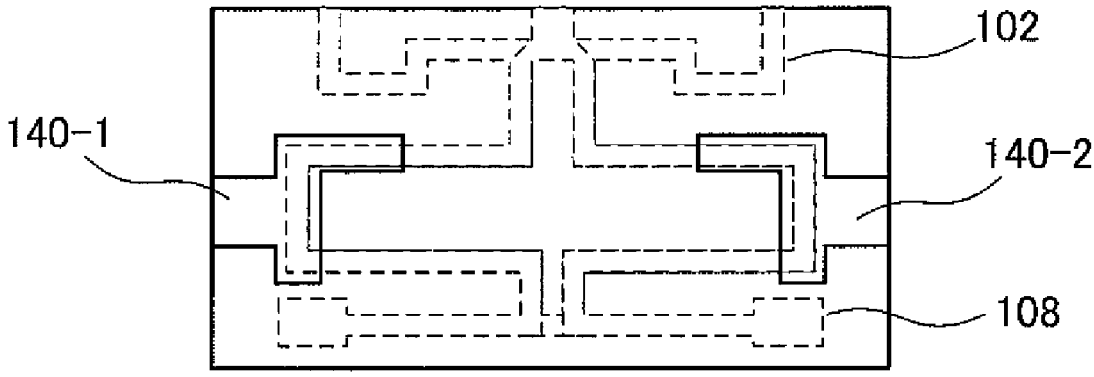
FIG. 21 is a seeing-through plan view showing still another example of the trap control coupling electrode shown in FIG. 18.

FIG. 21 is a seeing-through plan view showing still another example of the trap control coupling electrode shown in FIG. 19. As shown in FIG. 21, the trap control coupling electrode may be constituted as left and right coupling electrodes 140-1 and 140-2 such that the coupling is established between the unbalanced-side resonance electrode 102 and the resonance electrode 108 in positions where the spacing between the left and right strip-lines constituting the unbalanced-side resonance electrode 102 and the resonance electrode 108 are farthest away from each other, and the coupling electrodes 140-1 and 140-2 are connected to the GND terminals formed at respective sides.

According to the present invention, a balanced filter having a high attenuation can be realized with a simple structure, and therefore applications to radio communication equipment under demands for a further size reduction are expected.

What is claimed is:

1. A balanced filter device, comprising:

an unbalanced-side resonance electrode coupled to an unbalanced terminal;

a first pair of resonance electrodes directly connected to a pair of balanced terminals, and at least one second pair of resonance electrodes, wherein said unbalanced side resonance electrode, said first pair of resonance electrodes and said at least one second pair of resonance electrodes are formed on different dielectric layers in a laminated arrangement, wherein the at least one second pair of resonance electrodes is interposed between said unbalanced-side resonance electrode and said first pair of resonance electrodes, wherein the device further comprises a coupling electrode interposed between said at least one second pair of resonance electrodes and said unbalanced-side resonance electrode, wherein said unbalanced-side resonance electrode comprises a $\lambda/2$ strip-line folded into two substantially equal $\lambda/4$ strip-line portions, and wherein said coupling electrode couples the folding point of the $\lambda/2$ strip-line to at least one point on each of the two $\lambda/4$ strip-line portions.

2. A balanced filter device, comprising:

an unbalanced-side resonance electrode coupled to an unbalanced terminal;

a first pair of resonance electrodes directly connected to a pair of balanced terminals, and at least one second pair of resonance electrodes, wherein said unbalanced side resonance electrode, said first pair of resonance electrodes and said at least one second pair of resonance electrodes are formed on different dielectric layers in a laminated arrangement, wherein the second pair of resonance electrodes is interposed between said unbalanced-side resonance electrode and said first pair of resonance electrodes, wherein the device further comprises a coupling electrode interposed between said second pair of resonance electrodes and said unbalanced-side resonance electrode, wherein said at least one second pair of resonance electrodes comprises two strip-lines each having a length of about λ/4, and wherein said coupling electrode couples said two strip-lines to each other.

3. A balanced filter device, comprising:

an unbalanced-side resonance electrode coupled to an unbalanced terminal;

a first pair of resonance electrodes directly connected to a pair of balanced terminals, and at least one second pair of resonance electrodes, wherein said unbalanced side resonance electrode, said first pair of resonance electrodes and said second pair of resonance electrodes are formed on different dielectric layers in a laminated arrangement, wherein the at least one second pair of resonance electrodes is interposed between said unbalanced-side resonance electrode and said first pair of resonance electrodes, wherein the device further comprises a coupling electrode interposed between said at least one second pair of resonance electrodes and said unbalanced-side resonance electrode, wherein said unbalanced-side resonance electrode comprises two λ/4 strip-line portions, and wherein said coupling electrode couples said two λ/4 strip-line portions to each other.

4. The balanced filter device according to claim 3, wherein: the at least one second pair of resonance electrodes comprises a shorted end and an open end.

5. The balanced filter according to claim 3, wherein:

said coupling electrode couples a shorted-end side of said at least one second pair of resonance electrodes to an open-end side of said at least one second pair of resonance electrodes.

* * * * *